US005301943A

United States Patent [19]

Asztalos

[11] Patent Number: 5,301,943

[45] Date of Patent: Apr. 12, 1994

[54] PUZZLE WITH A TOROIDAL CHANNEL ENGAGING A PLURALITY OF TOROIDAL RINGS PERPENDICULAR THERETO

[76] Inventor: Imre Asztalos, 283 Bay 17 St., Apt. 3C, Brooklyn, N.Y. 11214

[21] Appl. No.: 955,308

[22] Filed: Oct. 1, 1992

[51] Int. Cl.[5] ..... A63F 9/08

[52] U.S. Cl. ..... 273/153 S; 273/113

[58] Field of Search ..... 273/153 S, 153 R, 113, 273/155

[56] References Cited

U.S. PATENT DOCUMENTS 4,413,823 11/1983 Breslow ..... 273/153 S
4,468,033 8/1984 Minami et al. ..... 273/153 S
5,172,912 12/1992 Lammertink ..... 273/153 S
5,176,382 1/1993 Hausammann ..... 273/153 S

*Primary Examiner*—Vincent Millin
*Assistant Examiner*—Steven B. Wong
*Attorney, Agent, or Firm*—Kane, Dalsimer, Sullivan, Kurucz, Levy, Eisele and Richard

[57] ABSTRACT

The apparatus is a puzzle which includes a central toroidal channel with a rotating cogged wheel therein. A plurality of hollow toroidal rings intersect perpendicular to the central toroidal channel. These toroidal rings include balls of different colors. These balls pass from toroidal ring to toroidal ring through the toroidal channel. The object of the puzzle is to intermix balls of different colors and then rearrange the balls so that all balls of a single color are in a single toroidal ring.

15 Claims, 3 Drawing Sheets

PUZZLE WITH A TOROIDAL CHANNEL ENGAGING A PLURALITY OF TOROIDAL RINGS PERPENDICULAR THERETO

BACKGROUND OF THE INVENTION

1. Field of the Invention

The present invention relates to a puzzle which includes a toroidal channel with a rotating cogged wheel therein. A plurality of hollow toroidal rings intersect perpendicular to the toroidal channel. These rings include balls of different colors. These balls pass from ring to ring through the toroidal channel.

2. Description of the Prior Art

The "Rubik's Cube" (a similar device is disclosed in U.S. Pat. No. 3,655,021, which was involved in litigation) and other puzzles are well-known. These puzzles are used for the entertainment, stimulation and education of children and adults alike. The use of a plurality of bright colors enhances the fascination which children have with these puzzles. Many of these puzzles may be solved by inducing or learning elegant algorithms thereby stimulating the spatial comprehension of children.

SUMMARY OF THE INVENTION

The puzzle of the present invention includes a central toroidal channel with a primary rotating cogged wheel therein. A plurality of hollow toroidal rings intersect perpendicular to the central toroidal channel. The hollow toroidal rings include a plurality of balls each engaged by a secondary rotating cogged wheel. Initially each toroidal ring includes several balls of the same color, but different from the color of the balls of any other toroidal ring. Balls pass from one toroidal ring to another through the toroidal channel so as to be scrambled. The object of the puzzle is to arrange balls of randomly scrambled colors within the plurality of toroidal rings so that, finally, each toroidal ring includes balls of a single color as in the initial state. This is done by alternating steps of 1) positioning the balls within each toroidal ring by rotating the secondary rotating cogged wheels so that selected balls are engaged by the primary rotating cogged wheel within the toroidal channel and 2) rotating the primary rotating cogged wheel within the toroidal channel so that balls are transferred from one toroidal ring to another.

BRIEF DESCRIPTION OF THE DRAWINGS

Further objects and advantages of the invention will become apparent from the following description and claims, and from the accompanying drawings, wherein:

DETAILED DESCRIPTION OF THE PREFERRED EMBODIMENT

Figure 1:
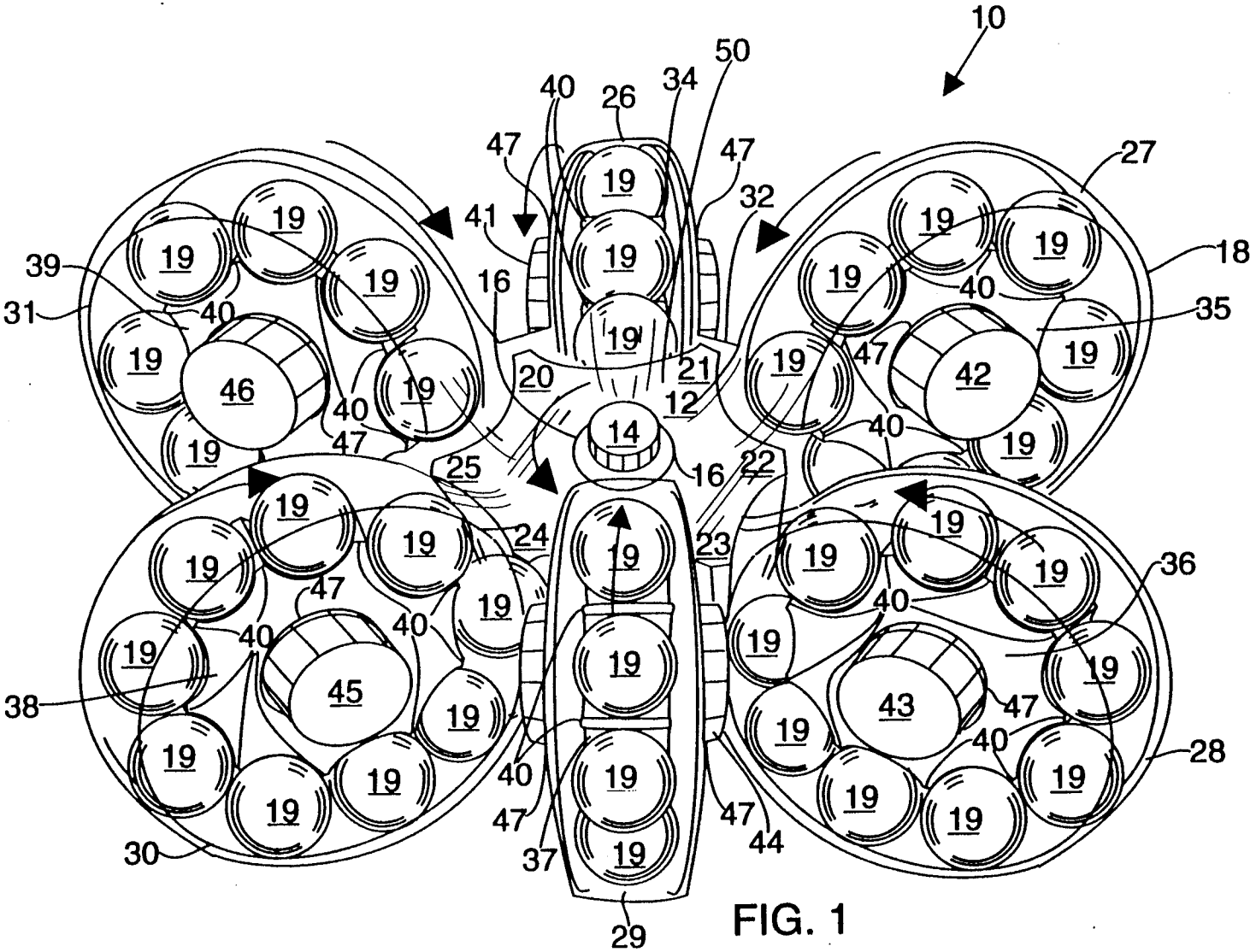
FIG. 1 is a perspective view of the apparatus of the present invention.
Figure 2:
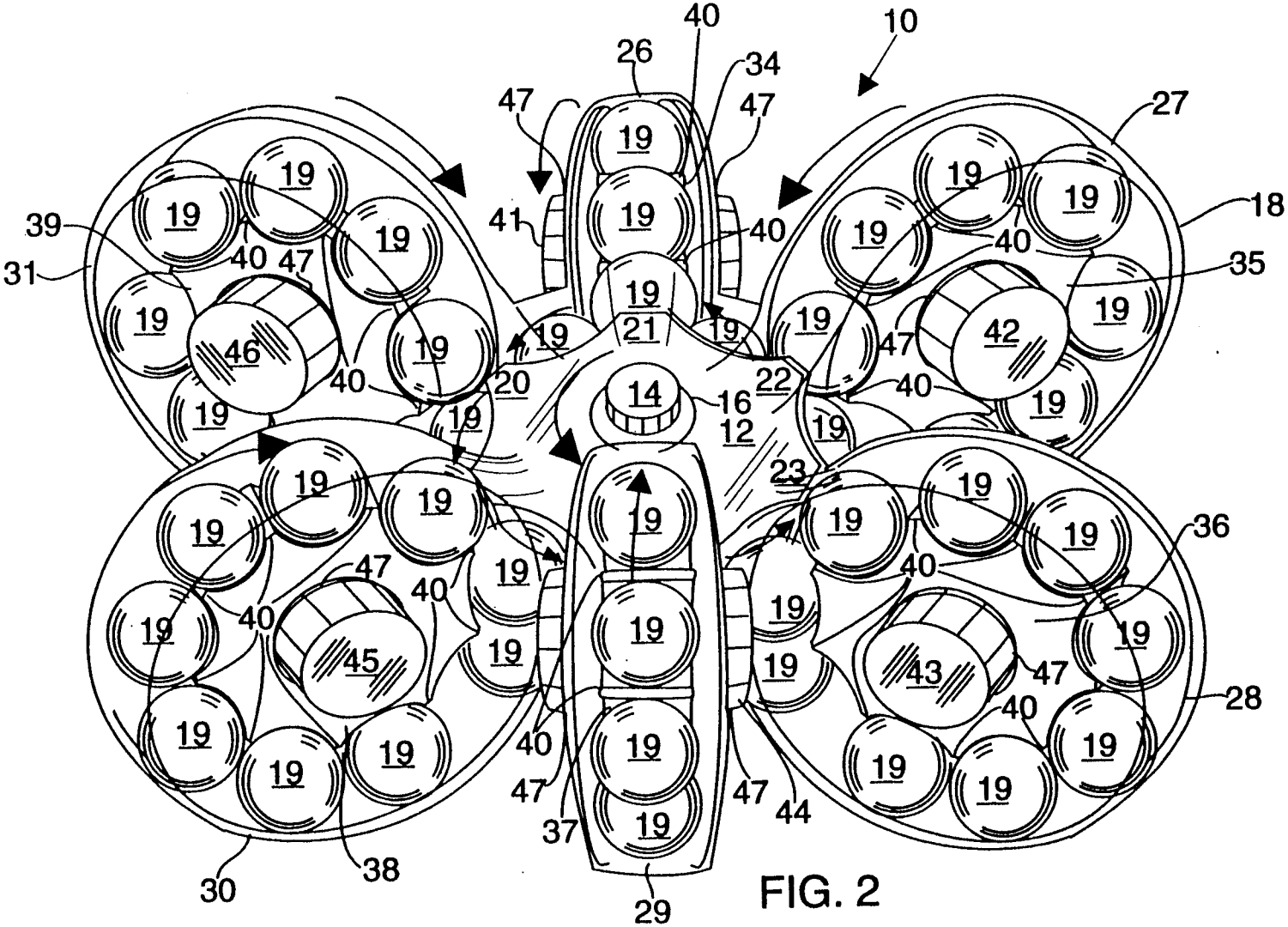
FIG. 2 is a perspective view of the apparatus of the present invention with the primary rotating cogged wheel positioned so that the balls within the toroidal channel are in an intermediate position between toroidal rings.

Referring now to the drawings in detail wherein like numerals refer to like elements throughout the several views, one sees that FIG. 1 is a perspective view of apparatus 10. Although a bottom view is not shown, the bottom of apparatus 10 is preferably substantially symmetric with the top thereof. Apparatus 10 includes a primary rotating cogged wheel 12 which is journaled for rotation along an axis defined by double-ended knob 14 protruding through aperture 16 in clear plastic shell 18 (although not shown, the second side of knob 14 passes through a corresponding aperture on the bottom of shell 18). Knob 14 is preferably knurled to allow children to grip knob 14 firmly. Primary rotating cogged wheel 12 further includes cogs 20–25. The rotation of primary rotating cogged wheel 12 defines toroidal channel 32 (that is, a circular path with a constant oval cross section, the oval cross section allows the urging of two balls 19 at a time from each toroidal ring 26–31 by primary rotating cogged wheel 12, however, a circular cross section would suffice if only one ball 19 from each toroidal ring 26–31 were so urged at a time) through which balls 19 pass from toroidal ring to toroidal ring 26–31 in response to the user turning knob 14 thereby turning primary rotating cogged wheel 12 as shown in FIG. 2 (wherein primary rotating cogged wheel 12 is positioned so that the balls 19 within the toroidal channel 32 are in an intermediate position, i.e. one half increment). As used with regard to primary rotating cogged wheel 12, the term "increment" shall refer to the amount of rotation required to move the balls 19 which are engaged by cogs 20–25 from one toroidal ring 26–31 to the next adjacent toroidal ring. While balls 19 are preferably spherical, the term "balls" refers to any suitable geometric shape.

Figure 4:
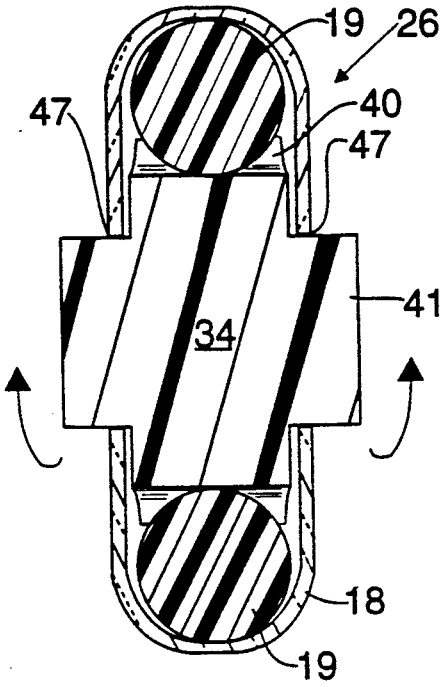
FIG. 4 is a radial cross-sectional view of a toroidal ring.
Figure 3:
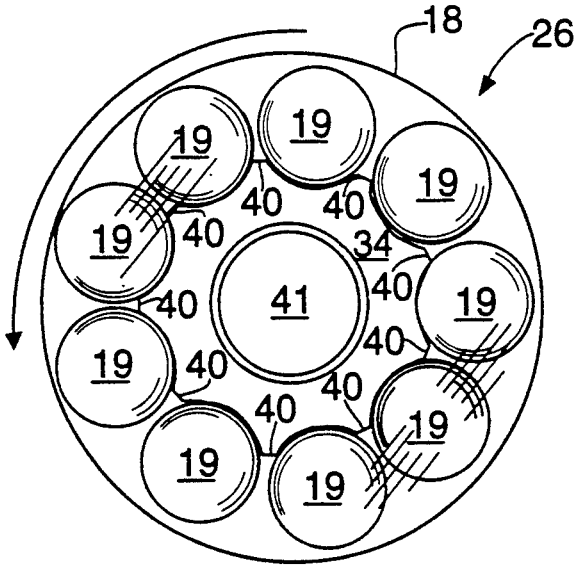
FIG. 3 is a side view of one of the toroidal rings and the secondary rotating cogged wheel engaging balls therewithin.

Toroidal rings 26–31, which include balls 19 as shown in FIG. 3, are perpendicular to toroidal channel 32 and intersect toroidal channel 32 at equispaced positions throughout the periphery thereof. As can be seen from FIG. 4, clear plastic shell 18 forms a doughnut-shaped or toroidal partially circular cross section through the periphery of toroidal rings 26–31 through which balls 19 travel. Toroidal rings 26–31 further include secondary rotating cogged wheels 34–39, respectively, with cogs 40 thereon to rotationally urge balls 19 around the interior of toroidal rings 26–31. Secondary rotating cogged wheels 34–39 are journaled for rotation along axes defined by double-ended knobs 41–46 extending through apertures 47 (for simplicity, all apertures of this character are illustrated with a single indicia, see FIG. 4 for a cross-sectional view of toroidal ring 26 with double-ended knob 46, further showing the interior of toroidal ring 26 through which balls 19 pass) of clear plastic shell 18. As with knob 14, knobs 41–46 are preferably knurled to allow children to grip knobs 41–46 firmly. As used with regard to secondary rotating cogged wheels 34–39, the term "increment" shall refer to the amount of rotation required to move the balls 19 which are engaged by cogs 40 by the circumferential amount subtended by a single ball 19 within the toroidal ring 26–31 (that is, the amount of rotation to move the balls 19 to the next adjacent location within the toroidal ring 26–31).

Preferably, all of the axes of rotation defined by knobs 41-46 passing through various apertures 47 lie in a single plane which is parallel to the face 50 of primary rotating cogged wheel 12 and perpendicular to the axis of rotation defined by knob 14 passing through aperture 16. Preferably, primary rotating cogged wheel 12 has a sufficient width to engage two adjacent balls 19 from each toroidal ring to a successive toroidal ring 26–31 as primary rotating cogged wheel 12 is rotated.

Balls 19 are preferably provided in a number of colors equal to the number of toroidal rings 26–31. In the illustrated embodiment, balls of six colors would be provided, such as red, blue, yellow, purple, orange and green. Of course, any other distinctive colors or shades, such as black and white, may be substituted. The number of balls of any single color is equal to the number of balls held in a single toroidal ring 26–31, such as nine as shown in FIG. 3. Alternately, colors may be replaced by numbers on a ball. That is, instead of a color chosen from one of six colors, the balls could include a number chosen from 1–6.

Apparatus 10 may be initially provided to the user in either a "solved" or "scrambled" configuration. In the "solved" configuration, each toroidal ring 26–31 includes balls 19 of a single color only. For example, toroidal ring 26 includes nine balls 19 which are all red, toroidal ring 27 includes nine balls which all blue, toroidal ring 28 includes nine balls 19 which are all yellow, etc.

In the "scrambled" configuration, however, balls 19 of the various colors are randomly or pseudo-randomly arranged throughout the various toroidal rings 26–31.

As the user's object is to configure apparatus 10 from a "scrambled" to a "solved" configuration, the user, if initially provided with apparatus 10 in a "solved" configuration, will wish to scramble apparatus 10 by successively and alternately repeating the following two steps:

1. rotating primary rotating cogged wheel 12 by one or more (obviously not an integer multiple of the number of toroidal rings 26–31, such as six in the present example, as this would be a null operation) increments thereby urging cogs 20–25 against balls 19 within toroidal channel 32 moving two adjacent balls 19 from each toroidal ring 26–31 to successive adjacent toroidal rings; and 2. rotating one or more secondary rotating cogged wheels 34–39 by one or more (obviously not an integer multiple of the number of balls 19 in a toroidal ring 26–31, such as nine in the present example, as this would be a null operation) increments thereby urging cogs 40 against all of the balls 19 in a given toroidal ring 26–31 thereby changing the position of balls 19 within a given toroidal ring 26–31 and changing the balls within a given toroidal ring 26–31 which are engaged by the cogs 20–25 of primary rotating cogged wheel 12 within toroidal channel 32.

After apparatus 10 is in a "scrambled" configuration, the object is to put apparatus 10 into a "solved" configuration. This is done by methodically repeating the above two steps until the puzzle of apparatus 10 is solved.

Thus the several aforementioned objects and advantages are most effectively attained. Although a single preferred embodiment of the invention has been disclosed and described in detail herein, it should be understood that this invention is in no sense limited thereby and its scope is to be determined by that of the appended claims.

What is claimed is:

1. A puzzle apparatus including:

a central closed loop channel;

a plurality of peripheral closed lop channels intersecting substantially perpendicularly with said central closed loop channel and in communication with said central closed loop channel, said peripheral closed loop channels being toroidal with a circular path and a circular cross section, and said central closed loop channel being toroidal with a circular path;

a plurality of spherical balls which travel within said central closed loop channel and said plurality of peripheral closed loop channels, said balls being provided in M groups of N balls each, each of M groups being a different color one from another, and wherein M is equal to the number of peripheral closed loop channels;

first means for urging said balls to traverse said central closed loop channel;

second means for urging said balls to traverse said peripheral closed loop channels;

wherein said balls travel a path including said central closed loop channel and said plurality of peripheral closed loop channels in response to said first and second means for urging.

2. The puzzle apparatus of claim 1 wherein said first means for urging is a first wheel within said central closed loop channel, said first wheel including first means for engaging said balls within said central closed loop channel.

3. The puzzle apparatus of claim 2 wherein said second means for urging is a second wheel within each of said peripheral closed loop channels, said second wheels including second means for engaging said balls within said respective peripheral closed loop channels.

4. The puzzle apparatus of claim 3 wherein said first and second means for urging include cog means.

5. The puzzle apparatus of claim 4 wherein said first wheel and said second wheels include knob means for the user to turn thereby urging said balls around respective said central and peripheral closed loop channels.

6. The puzzle apparatus of claim 5 wherein said knob means include a first knob means at a first side of respective said central and peripheral closed loop channels and a second knob means at a second side of respective said central and peripheral closed loop channels.

7. The puzzle apparatus of claim 6 wherein said central and peripheral closed loop channels are formed from a shell of substantially clear plastic.

8. The puzzle apparatus of claim 7 wherein said shell includes apertures engaging said first and second knob means thereby providing axes of rotation for said first and second means for urging.

9. The puzzle apparatus of claim 8 wherein said apertures are substantially round and wherein said first and second knob means include a round cross section to be engaged by respective said apertures.

10. The puzzle apparatus of claim 9 wherein said axes of rotation for each of said second means for urging are substantially on a single plane.

11. The puzzle apparatus of claim 10 wherein said axis of rotation for said first means for urging is substantially perpendicular to said single plane.

12. The puzzle apparatus of claim 11 wherein said shell is substantially symmetric about said single plane.

13. The puzzle apparats of claim 12 wherein said peripheral closed loop channels are substantially equally spaced about said central closed loop channel.

14. The puzzle apparatus of claim 13 wherein said first means for urging urges two balls from each peripheral closed loop channel to traverse said central closed loop path to successive peripheral closed loop channels.

15. The puzzle apparatus of claim 14 wherein each of said knob means includes a knurled portion.

* * * * *